US012569713B2

(12) United States Patent
Wu et al.

(10) Patent No.: US 12,569,713 B2
(45) Date of Patent: Mar. 10, 2026

(54) MULTI-HANDLE DUMBBELL

(71) Applicant: VONRANG INTERNATIONAL CORPORATION, Taipei City (TW)

(72) Inventors: Chun-Yi Wu, Taipei City (TW); Wayne Tsu-Wei Liu, Taipei City (TW); Jue-An Liu, Taipei City (TW)

(73) Assignee: VONRANG INTERNATIONAL CORPORATION, Taipei City (TW)

( * ) Notice: Subject to any disclaimer, the term of this patent is extended or adjusted under 35 U.S.C. 154(b) by 0 days.

(21) Appl. No.: 18/826,441

(22) Filed: Sep. 6, 2024

(65) Prior Publication Data

US 2025/0319345 A1 Oct. 16, 2025

(30) Foreign Application Priority Data

Apr. 16, 2024 (TW) ..... 113114192

(51) Int. Cl.
*A63B 21/072* (2006.01)
*A63B 21/00* (2006.01)

(52) U.S. Cl.
CPC ..... *A63B 21/0726* (2013.01); *A63B 21/4035* (2015.10)

(58) Field of Classification Search
CPC ..... A63B 21/0726; A63B 21/4035; A63B 21/075; A63B 21/0722; A63B 21/0724; A63B 21/0728; A63B 21/072
See application file for complete search history.

(56) References Cited

U.S. PATENT DOCUMENTS

2011/0028285 A1* 2/2011 Towley, III ..... A63B 21/075 482/108
2014/0024506 A1 1/2014 Vixathep
(Continued)

FOREIGN PATENT DOCUMENTS

BR 112019001546 B1 * 12/2022 ..... A63B 21/027
CN 107469276 A * 12/2017 ..... A63B 21/0726
KR 101622082 B1 * 5/2016 ..... A63B 21/072

OTHER PUBLICATIONS

TW Notice of Allowance Dated Jun. 28, 2024 as received in Application No. 113114192.
(Continued)

*Primary Examiner* — Megan Anderson
*Assistant Examiner* — Jacqueline N L Loberiza
(74) *Attorney, Agent, or Firm* — Maschoff Brennan

(57) ABSTRACT

The present invention discloses a multi-handle dumbbell comprising: two counterweights, a central handle and three surrounding handles. The central handle and the three surrounding handles are provided for a user to grip, both ends of the central handle are respectively connected to the centers of the two counterweights, the three surrounding handles are disposed around and parallel to the central handle, each surrounding handle is provided with two ends thereof respectively connected to the two counterweights, and the three surrounding handles are spaced equidistantly from each other. By gripping the central handle, the user can perform weight training with a movement suitable for a conventional dumbbell, and by gripping the surrounding handle, the user can perform weight training with a movement suitable for a conventional kettlebell.

4 Claims, 2 Drawing Sheets

(56) References Cited

U.S. PATENT DOCUMENTS

| | | | | |
|---|---|---|---|---|
| 2015/0306446 | A1 | 10/2015 | Spainhower | |
| 2022/0152445 | A1 * | 5/2022 | Harker | A63B 21/4035 |
| 2022/0249899 | A1 | 8/2022 | Olson | |

OTHER PUBLICATIONS

TW Search Report Dated Jun. 28, 2024 as received in Application No. 113114192.

* cited by examiner

MULTI-HANDLE DUMBBELL

FIELD OF THE INVENTION

The present invention relates to a dumbbell, and more particularly relates to a multi-handle dumbbell.

BACKGROUND OF THE INVENTION

Weight training is training by loading heavy objects or specific equipment to increase muscle strength or muscle endurance. Weight training mainly includes free-weights training and weight machine training, wherein free-weights training refers to heavy-objects training using dumbbells, barbells, kettlebells and so on which are not attached to any weight machine. The free-weights equipment has different structures corresponding to their training movements. Therefore, in order to train with different training movements, a user has to purchase many kinds of free-weights equipment, resulting in space occupation and redundant operations in changing equipment during training.

SUMMARY OF THE INVENTION

Therefore, one objective of the present invention is to provide a multi-handle dumbbell suitable for different training movements for both a conventional dumbbell and a conventional kettlebell.

In order to overcome the technical problems in the prior art, the present invention provides a multi-handle dumbbell, comprising: two counterweights; a central handle provided for a user to grip, wherein both ends of the central handle are respectively connected to the centers of the two counterweights; and three surrounding handles provided for the user to grip, wherein the three surrounding handles are disposed around and parallel to the central handle, each surrounding handle is provided with two ends thereof respectively connected to the two counterweights, and the three surrounding handles are spaced equidistantly from each other.

In one embodiment of the present invention, the multi-handle dumbbell is provided, wherein the multi-handle dumbbell is defined with three dividing regions divided by perpendicular bisectors of line segments between each two adjacent surrounding handles, and the three dividing regions form a moment balance relative to the center of the multi-handle dumbbell.

In one embodiment of the present invention, the multi-handle dumbbell is provided, wherein the center of the three surrounding handles is offset from the center of the central handle.

In one embodiment of the present invention, the multi-handle dumbbell is provided, wherein a diameter of the central handle is greater than that of the surrounding handles.

In one embodiment of the present invention, the multi-handle dumbbell is provided, wherein the counterweight is a square plate with rounded corners.

In one embodiment of the present invention, the multi-handle dumbbell is provided, wherein the central handle has a gripping portion and two connecting portions respectively provided at two end parts of the gripping portion, and a diameter of the gripping portion of the central handle gradually decreases from a middle part of the gripping portion to the two end parts of the gripping portion.

In one embodiment of the present invention, the multi-handle dumbbell is provided, wherein the surrounding handle has a gripping portion and two connecting portions respectively provided at two end parts of the gripping portion, and a diameter of the gripping portion of the surrounding handle gradually decreases from a middle part of the gripping portion to the two end parts of the gripping portion.

With the technical means adopted by the multi-handle dumbbell of the present invention, the multi-handle dumbbell has the overall center of gravity at the central handle thereof, allowing the user to perform weight training with a movement suitable for a conventional dumbbell by gripping the central handle. On the other hand, the overall center of gravity of the multi-handle dumbbell is offset from each surrounding handle and also from the line segments between each two adjacent surrounding handles, allowing the user to perform weight training with a movement suitable for a conventional kettlebell by gripping the surrounding handle with one hand or by gripping any two surrounding handles with each hand. Therefore, the multi-handle dumbbell can reduce the space occupation and eliminate the redundant operations in changing equipment during training.

DETAILED DESCRIPTION OF THE PREFERRED EMBODIMENTS

The preferred embodiments of the present invention are described in detail with reference to FIGS. 1 to 4. The description is used for explaining the embodiments of the present invention only, but not for limiting the scope of the claims.

Figure 1:
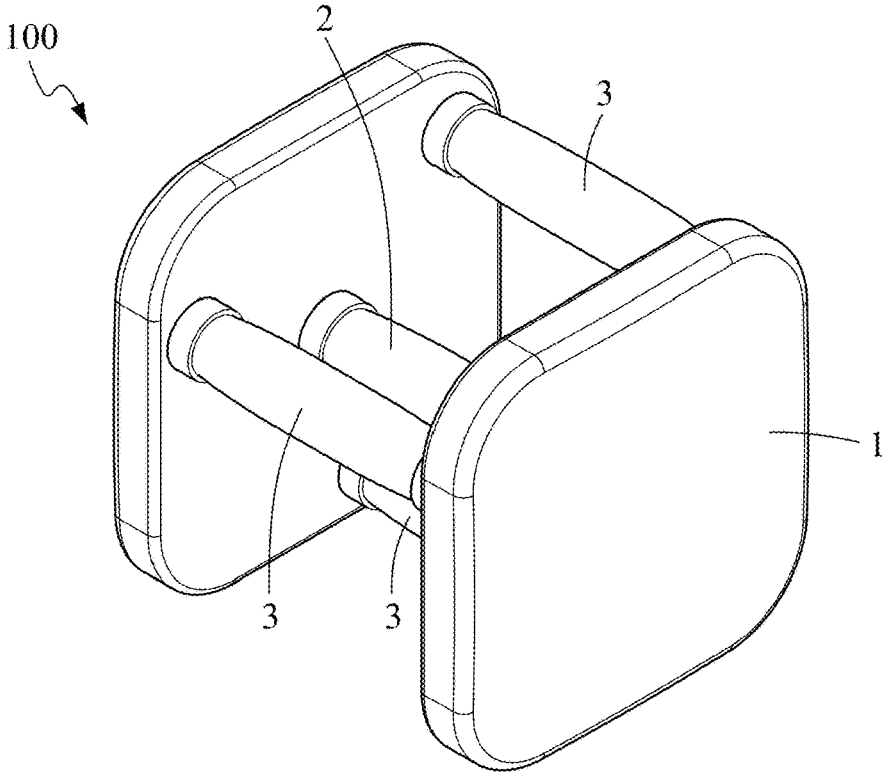
FIG. 1 is a schematic perspective view illustrating a multi-handle dumbbell according to one embodiment of the present invention.
Figure 2:
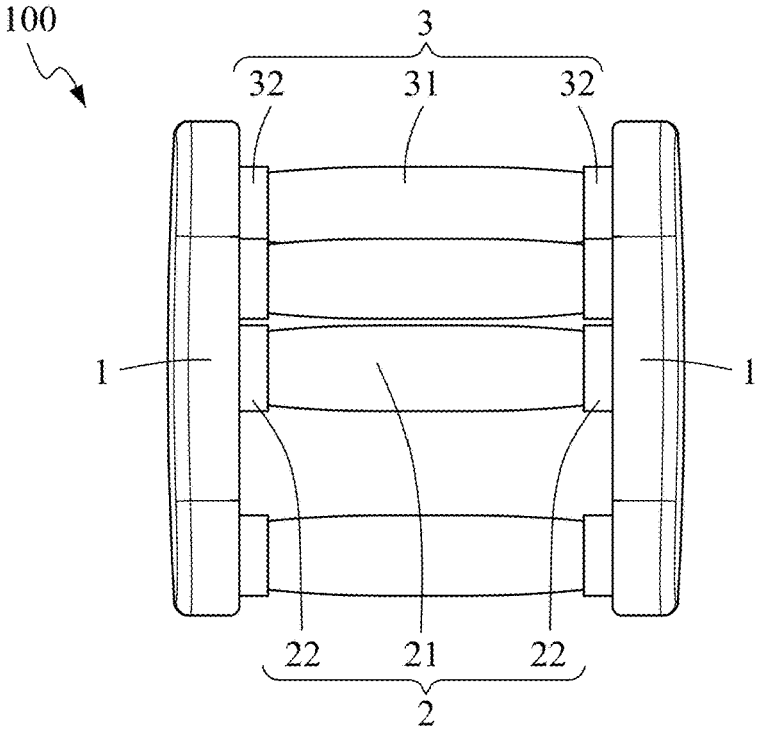
FIG. 2 is a schematic side view illustrating the multi-handle dumbbell according to the embodiment of the present invention.
Figure 3:
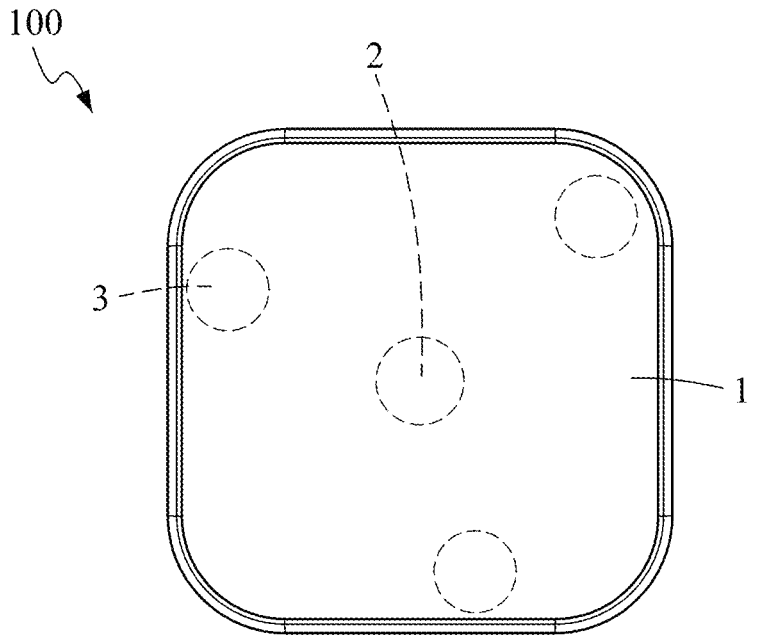
FIG. 3 is a schematic front view illustrating the multi-handle dumbbell according to the embodiment of the present invention.

As shown in FIGS. 1 to 3, a multi-handle dumbbell 100 according to one embodiment of the present invention comprises: two counterweights 1, a central handle 2 and three surrounding handles 3.

The two counterweights 1 have the same shape and weight. The two counterweights 1 are made of hard materials which generally are cast irons or other metals, or are produced by covering the hard materials with soft materials, such as rubber and sponge. The counterweight 1 is symmetrical relative to the center thereof. In the present embodiment, the counterweight 1 is a square plate with rounded corners, which is a structure that does not roll easily and reduces possible damage to the corners thereof due to collision. Certainly, in other embodiment, the counterweight 1 may also be a rounded plate or a hexagonal plate, or a polyhedron.

The central handle 2 is provided for a user to grip. Both ends of the central handle 2 are respectively connected to the centers of the two counterweights 1. Because the gravity center of the whole multi-handle dumbbell 100 is provided at the central handle, the user is allowed to perform weight training with a movement suitable for a conventional dumbbell by gripping the central handle 2.

The central handle 2 has a gripping portion 21 and two connecting portions 22 respectively provided at two end parts of the gripping portion 21. The two connecting portions 22 of the central handle 2 are respectively connected to the centers of the two counterweights 1. A diameter of the gripping portion 21 of the central handle 2 gradually decreases from a middle part of the gripping portion 21 to the two end parts of the gripping portion 21 such that the user can more firmly grip the central handle 2. Certainly, in other embodiment, the gripping portion 21 of the central handle 2 may also have an overall uniform diameter.

The three surrounding handles 3 are provided for the user to grip. The three surrounding handles 3 are disposed around and parallel to the central handle 2. Each surrounding handle 3 is provided with two ends thereof respectively connected to the two counterweights 1. The three surrounding handles 3 are spaced equidistantly from each other, that is, the three surrounding handles 3 are respectively positioned at the three vertices of an equilateral triangle.

The gravity center of the whole multi-handle dumbbell 100 is offset from each surrounding handle 3, allowing the user to perform weight training with a movement suitable for a conventional kettlebell by gripping anyone of the surrounding handles with one hand. On the other hand, the gravity center of the whole multi-handle dumbbell 100 is offset from line segments between each two adjacent surrounding handles 3, allowing the user to perform weight training with a movement suitable for the conventional kettlebell by griping any two of the surrounding handles 3 with each hand.

The surrounding handle 3 has a gripping portion 31 and two connecting portions 32 respectively provided at two end parts of the gripping portion 31. The two connecting portions 32 of each surrounding handle 3 are respectively connected to the two counterweights 1. A diameter of the gripping portion 31 of the surrounding handle 3 gradually decreases from a middle part of the gripping portion 31 to the two end parts of the gripping portion 31 such that the user can more firmly grip the surrounding handle 3. Certainly, in other embodiment, the gripping portion 31 of the surrounding handle 3 may also have an overall uniform diameter.

Figure 4:
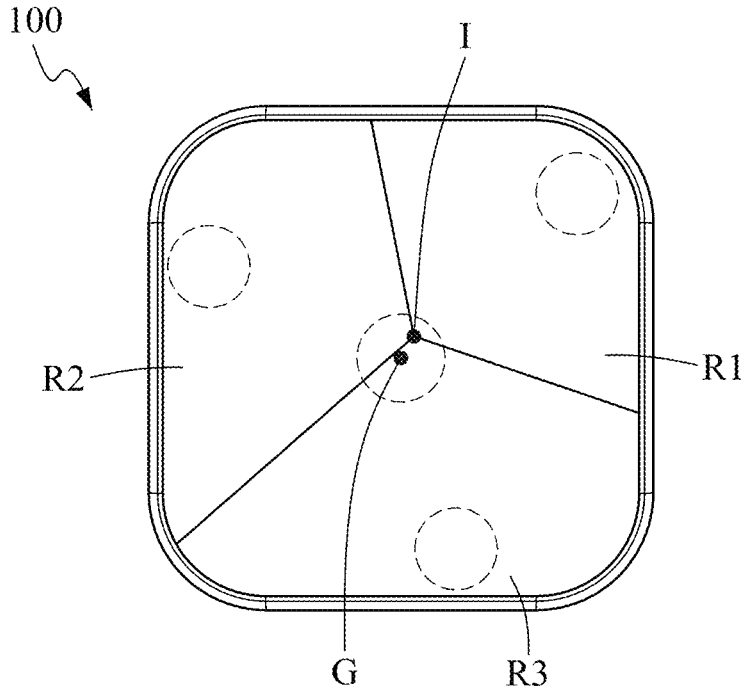
FIG. 4 is another schematic front view illustrating the multi-handle dumbbell according to the embodiment of the present invention.

As shown in FIG. 4, in the multi-handle dumbbell 100 according to the embodiment of the present invention, perpendicular bisectors of line segments between each two adjacent of the three surrounding handles 3 intersect at the center I of the surrounding handles 3, and the multi-handle dumbbell 100 is defined with three dividing regions R1, R2 and R3 divided by the three perpendicular bisectors and the center I of the surrounding handles 3. The locations of the three surrounding handles 3 are obtained by computation with Gaussian functions such that the densities of three-dimension space of the three regions R1, R2 and R3 are substantially the same. The locations of the three surrounding handles 3 are configured to form a moment balance relative to the center of the multi-handle dumbbell 100, i.e., the center G of the central handle 2. Under the configuration mentioned above, since each counterweight 1 of square plates cannot be divided into three regions having the same shape, the center I of the three surrounding handles 3 is offset from the center G of the central handle 2. However, in the embodiments of the counterweights 1 of triangle plate or hexagonal plate, the center I of the three surrounding handles 3 coincides with the center G of the central handle 2.

The central handle 2 and the surrounding handles 3 are made of hard materials which generally are cast irons or other metals, or are produced by covering the hard materials with soft materials, such as rubber and sponge. Preferably, the main materials of the central handle 2 and the surrounding handles 3 are the same as that of the counterweights 1.

As shown in FIG. 3, a diameter of the central handle 2 is greater than that of the surrounding handles 3. In the present embodiment, the ratio of the dimeter of the central handle 2 to that of the surrounding handles 3 is 15:14. Certainly, the ratio of the diameter of the central handle 2 to that of the surrounding handles 3 is not limited to this. The user has to exert more force to grip the handle having smaller diameter to resist the moment caused by the handle of the multi-handle dumbbell 100 gripped so that the training effect on gripping strength and/or finger strength is obtained. In other embodiments, the diameter of the central handle 2 may be equal to that of the surrounding handles 3, or the diameter of the central handle 2 may be less than that of the surrounding handles 3.

In the present embodiment, the counterweights 1, the central handle 2 and the surrounding handles 3 can be assembled together by assembling components, such as screws, so that the user can replace the counterweights 1 to change the weight of the whole multi-handle dumbbell 100 and the training strength.

The above description should be considered as only the discussion of the preferred embodiments of the present invention. However, a person having ordinary skill in the art may make various modifications without deviating from the present invention. Those modifications still fall within the scope of the present invention.

What is claimed is:

1. A multi-handle dumbbell, comprising:

two counterweights of square plates;

a central handle provided for a user to grip, wherein both ends of the central handle are respectively connected to the centers of the two counterweights; and three surrounding handles provided for the user to grip, wherein the three surrounding handles are disposed around and parallel to the central handle, each surrounding handle is provided with two ends thereof respectively connected to the two counterweights, and the three surrounding handles are spaced equidistantly from each other, wherein each of the two counterweights is defined with three dividing regions of different shapes divided by three perpendicular bisectors of line segments between each two adjacent surrounding handles of the three surrounding handles, one of the three surrounding handles is closer to the central handle than the other two surrounding handles, and one of the three perpendicular bisectors is longer than the other two perpendicular bisectors, thereby offsetting a moment balance relative to the center of the central handle.

2. The multi-handle dumbbell of claim 1, wherein a diameter of the central handle is greater than that of each handle of the three surrounding handles.

3. The multi-handle dumbbell of claim 1, wherein the central handle has a gripping portion and two connecting portions respectively provided at two end parts of the gripping portion, and a diameter of the gripping portion of the central handle gradually decreases from a middle part of the gripping portion to the two end parts of the gripping portion.

4. The multi-handle dumbbell of claim 1, wherein each handle of the three surrounding handles has a gripping portion and two connecting portions respectively provided at two end parts of the gripping portion, and a diameter of the gripping portion of each handle of the three surrounding handles gradually decreases from a middle part of the gripping portion to the two end parts of the gripping portion.

* * * * *